United States Patent [19]

Tonello

[11] . Patent Number: 4,536,748

[45] Date of Patent: Aug. 20, 1985

[54] PROCESS FOR PROTECTING A REMOTE MONITORING SYSTEM AGAINST SABOTAGE AND A SYSTEM USING THIS PROCESS

[75] Inventor: Marc Tonello, Chatou, France

[73] Assignee: Compagnie Europeenne de Teletransmission C.E.T.T., Chatou, France

[21] Appl. No.: 489,355

[22] Filed: Apr. 28, 1983

[30] Foreign Application Priority Data

Apr. 30, 1982 [FR] France ..... 82 07523

[51] Int. Cl.[3] ..... G08B 29/00; G08B 26/00

[52] U.S. Cl. ..... 340/506; 340/514; 340/518; 340/505; 340/511; 340/825.1

[58] Field of Search ..... 340/506, 505, 511, 514, 340/517, 518, 825.07, 825.1, 825.14, 825.54, 825.34, 870.09, 870.16, 870.17, 870.21

[56] References Cited

U.S. PATENT DOCUMENTS

| | | | |
|---|---|---|---|
| 3,665,399 | 5/1972 | Zehr et al. | 340/518 |
| 3,735,396 | 5/1973 | Getchell | 340/505 |
| 4,077,030 | 2/1978 | Helava | 340/870.21 |
| 4,162,489 | 7/1979 | Thilo et al. | 340/518 |

*Primary Examiner*—Donnie L. Crosland

*Attorney, Agent, or Firm*—Oblon, Fisher, Spivak, McClelland & Maier

[57] ABSTRACT

Each sensor of the system is connected to a central station and is interrogated cyclically. In turn, the sensors generate over a bus line a variable amplitude signal synthesized from data stored in a read only memory. Each sensor has a read only memory with different data and thus generates a different waveform during successive intervals of time. Any modification in the waveform of the signal transmitted by a sensor is interpreted as an alarm due to the detection of an intrusion, for example, or due to an attempt at sabotaging the sensor or the bus lines. The complexity of the waveforms synthesized by the sensors makes a simulation very difficult intended to neutralize the remote monitoring system.

3 Claims, 4 Drawing Figures

PROCESS FOR PROTECTING A REMOTE MONITORING SYSTEM AGAINST SABOTAGE AND A SYSTEM USING THIS PROCESS

BACKGROUND OF THE INVENTION

The invention relates to the protection of a remote monitoring system against sabotage intended to neutralize it, that is to say to make it inoperative while keeping it in an apparently normal operating condition. For example, a remote monitoring system for detecting an intrusion in premises is neutralized if the system is modified so that the sensors give a normal response whereas in fact they should signal an intrusion.

FIELD OF THE INVENTION

To avoid sabotage, each sensor of a conventional remote monitoring system is connected to the central station of the system by a line having four conductors: two forming a protection loop for detecting sabotage of the line, and two forming a detection loop charged with conveying alarm information. This line is possibly completed by other conductors for effecting a remote test of the sensors. It is known to detect sabotage of such a line by detecting a current, voltage or impedance variation. These processes are simple and can be easily neutralized by anyone having a little time and a minimum of technical knowledge at his disposal. On the other hand, several sensors are generally connected to the same line and it is not possible to distinguish which sensor transmits alarm information.

To remedy the disadvantages of these conventional processes, it is known to associate with each sensor a series or parallel resonating circuit connected to a bus line, to send successively over this line periodic signals of increasing frequency and to detect the impedance variations corresponding to the resonance of each of the resonating circuits. In such a process, neutralization of the system is much more difficult to perform and the response of each sensor is individualized since it corresponds to a different frequency value for each one. The implementation of this process is however delicate for the selectivity of the resonating circuits and their tuning frequency are affected by the characteristics of the line, which limits the number of sensors usable in the same line. On the other hand, in order that the circuits for analyzing the response of the sensors may be simple, it is necessary to carry out fine on-the-spot adjustments.

SUMMARY OF THE INVENTION

The process of the invention has as object to remedy these drawbacks by using simple means.

The invention provides then a process for protecting a remote monitoring system against sabotage, this system comprising a central station connected to a plurality of sensors, consisting:

in testing the state of each sensor of the system;

in transmitting, from a tested sensor to the central station of the system, a signal of variable amplitude formed from a wave-form synthesized from data stored in the sensor;

in authenticating this signal, when it arrives at the central station, by sampling it and comparing the value of each sample with a reference value.

BRIEF DESCRIPTION OF THE DRAWINGS

The invention will be better understood and other features will appear from the following description and the accompanying figures in which.

DESCRIPTION OF THE PREFERRED EMBODIMENT

Figure 1:
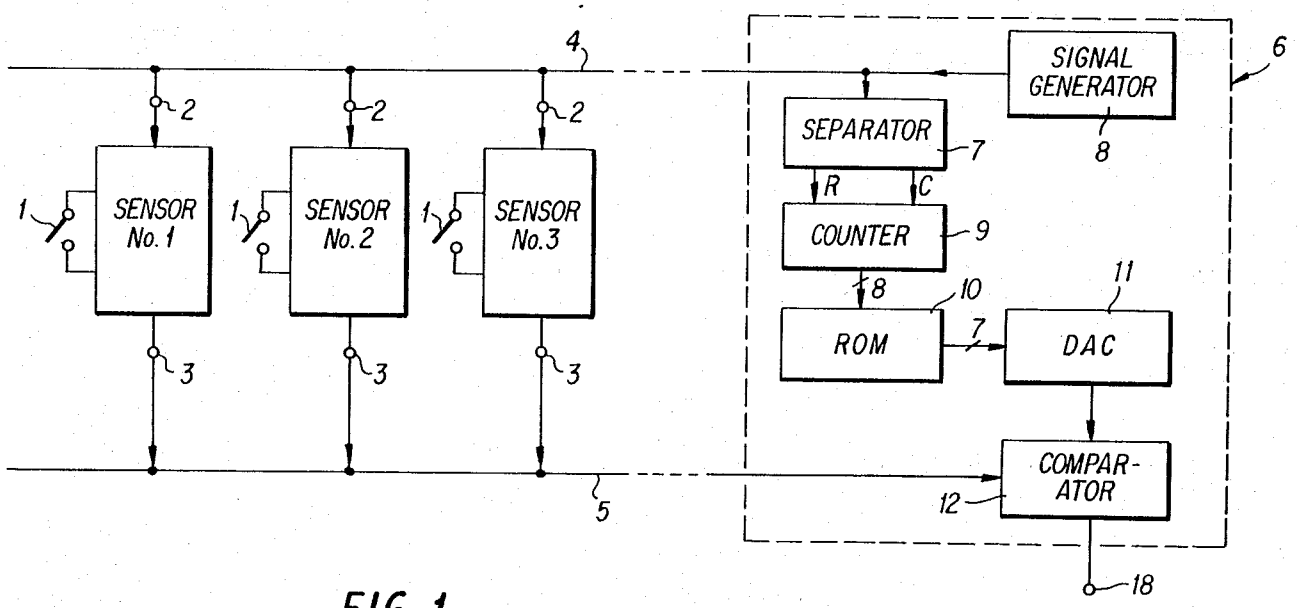
FIG. 1 shows the block diagram of one embodiment of a remote monitoring system.

The remote monitoring system shown in FIG. 1 is formed by a central station 6 and sensors n° 1, n° 2, n° 3 . . . , each having an input terminal 2 connected to a bus line 4 and an output terminal 3 connected to a bus line 5, bus lines 4 and 5 being connected to the central station 6. In this example, each sensor is connected to a switch 1 whose state is transmitted when the central station 6 interrogates the sensor. This switch 1 allows, for example, the opening of a door to be detected. In this example the system may comprise up to 16 sensors. To detect the change of state of a switch 1, or an abnormal operation of a sensor, each sensor is tested cyclically by interrogating it periodically from the central station 6.

Figures 2A, 2B:
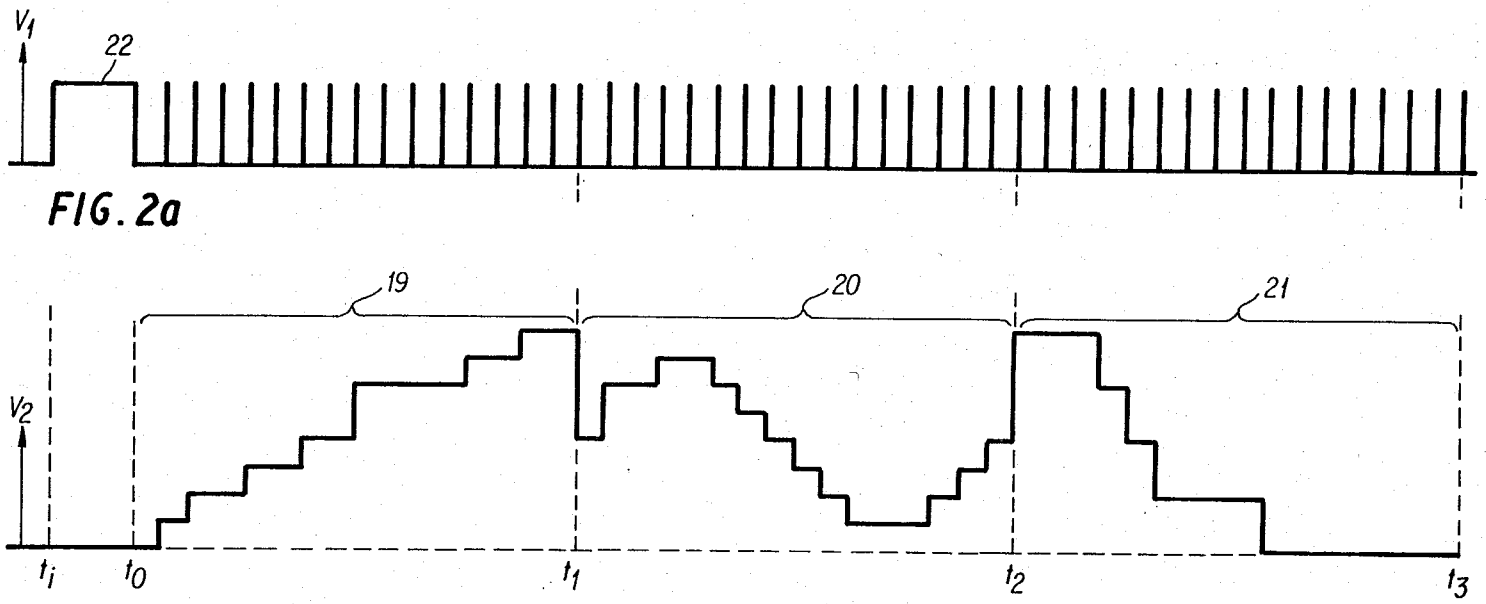
FIGS. 2*a* and 2*b* show the timing diagrams of an example of signals exchanged between the sensors and the central station of this remote monitoring system.

Central station 6 comprises a signal generator 8, a synchronizing signal and clock signal separator 7, a binary counter 9, a read only memory (ROM) 10, a digital-analog convertor 11 and an analog comparator 12. The signal generator 8 supplies a periodic binary signal $V_1$ which is shown in FIG. 2*a*. To scan the whole of the sensors of the system, signal generator 8 supplies a synchronizing pulse 22 between times $t_i$ and $t_o$, then 256 periodic pulses, of a period very much less than the time interval $t_i - t_o$. The output of signal generator 8 is connected to the bus line 4 and supplies then this signal to the input terminal 2 of each sensor. FIG. 2*b* shows the signal $V_2$ supplied to bus line 5 by the whole of the outputs of the sensors of the system. During the time interval $(t_i,t_o)$ the voltage present on line 5 is zero, then for a time interval $(t_o,t_l)$ sensor n° 1 supplies a variable voltage 19 formed of a succession of constant levels. During this time, the outputs of the other sensors supply no voltage and present a high impedance. During the time interval $(t_1,t_2)$, the output of sensor 2 delivers to bus line 5 another signal 20 whose voltage is variable, whereas the outputs of all the other sensors are at a high impedance. During the time interval $(t_2,t_3)$, the output of sensor n° 3 delivers a variable voltage 21, having a different form from the two preceding ones, whereas the outputs of the other sensors present a high impedance. In turn, each sensor supplies a signal to the bus line 5 for a time interval corresponding to 16 periodic pulses of the signal generator 8. Thus, 16 sensors may respond during each cycle of interrogation of the whole of the sensors. The signal transmitted by each sensor has a complex form, different for each of the sensors. If switch 1 connected to a sensor changes state, the shape of the signal transmitted by this sensor is modified to transmit this information. For example, the response signal $V_2$ may be replaced by a signal of zero value.

Figure 3:
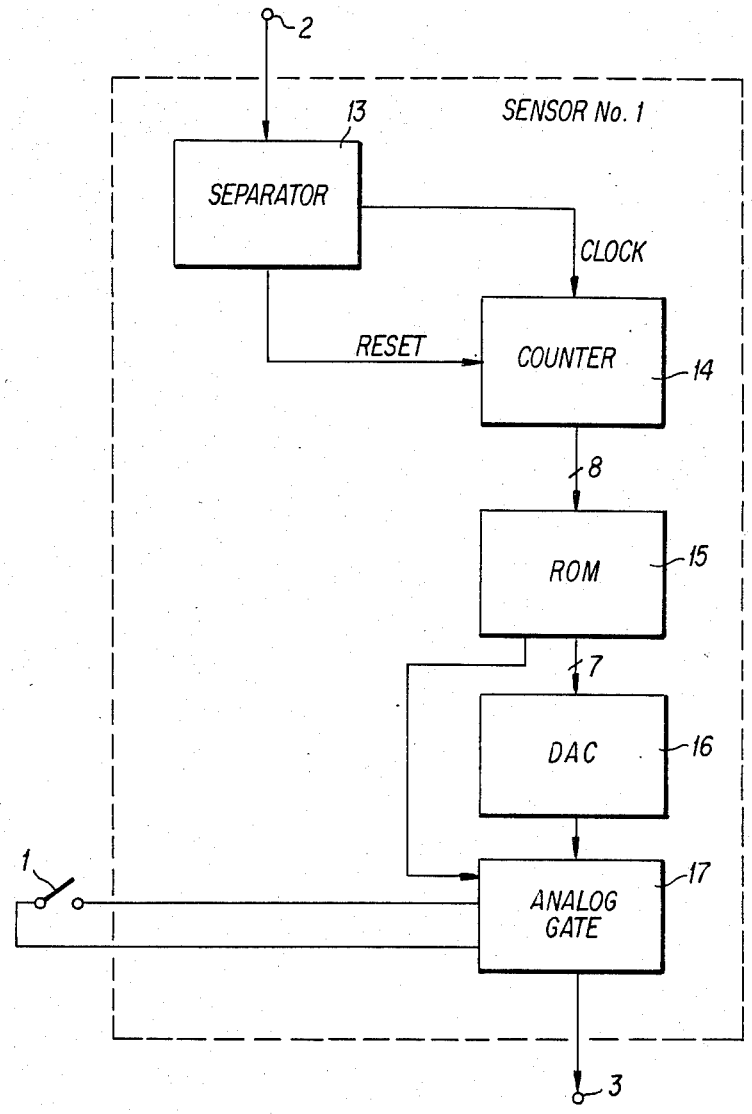
FIG. 3 shows the block diagram of one embodiment of a sensor.

FIG. 3 shows the block diagram of one embodiment of a sensor, such as sensor n° 1. The sensor comprises a synchronizing signal and clock signal separator 13, a binary counter 14, a ROM, a digital-analog convertor 16 and an analog gate 17. The input terminal 2 is connected to an input of separator 13 which supplies at a first output a logic signal when the central station sends to the input terminal 2 a synchronizing signal characterized by its duration $t_i - t_o$, and which supplies at a second output a clock signal formed by the periodic pulses which follow the synchronizing signal fed by the central station 6 to bus line 4. These signals are applied respectively to reset input and a clock input of the binary counter 14. This counter 14 comprises eight stages whose outputs are connected to eight address inputs of the ROM 15. The ROM 15 comprises eight data outputs, seven of which are connected to seven inputs of the digital-analog convertor 16, and an eighth one of which is connected to a first control input of the analog gate 17. An output of the digital-analog convertor 16 supplies an analog value to an input of gate 17. The output of gate 17 is connected to the output terminal 3 of the sensor.

At each scanning cycle of the whole of the sensors, the input terminal 2 receives, first of all, a synchronizing pulse, which is transmitted by separator 13 to the binary counter 14 for resetting same, then 256 clock pulses which are transmitted to the binary counter 14 so that it supplies successively 256 address values to memory 15. Memory 15 supplies at its eighth output a logic signal of value 1 for 16 consecutive address values corresponding to 16 consecutive clock pulses and thus enables the analog gate 17. Thus, for sensor n° 1, analog gate 17 is enabled for the time interval $(t_o, t_l)$. The other seven outputs of memory 15 supply successively 16 binary words of seven bits to the digital-analog convertor 16 which thus synthesizes a waveform composed of 16 plateaux whose amplitude may assume 128 values. When the state of switch 1 changes, gate 17 is disabled, the absence of response of the sensor thus triggers off an alarm.

The signals delivered successively by sensors n° 1, n° 2, n° 3, . . . are transmitted by the bus line 5 to the central station 6 where they are authenticated to check whether there is fraud and change of state of one of switches 1. In the central station 6 (FIG. 1), the output of signal generator 8 is connected to an input of the synchronizing signal and clock signal separator 7, identical to separator 13 of the sensors. Separator 7 provides a reset signal and a clock signal to the binary counter 9, identical to counter 14 of the sensors. The binary counter 9 has eight outputs which deliver, during each interrogation cycle, 256 binary words of eight bits to the address input of the ROM 10, which stores the whole of the data stored in the ROMs 15 of the sensors. This data is read into successive addresses in the order of interrogation of the sensors. The output of the ROM 10 supplies 256 binary words of 7 bits to the inputs of the digital-analog convertor 11, one output of which is connected to a first input of the comparator 12. A second input of comparator 12 is connected to the bus line 5, and an output of this comparator forms the output terminal 18 of the central station. The output of the digital-analog converter 11 delivers an analog signal whose waveform is formed by the succession of the waveforms of the signals expected as response from the sensors. Comparator 12 compares the succession of waveforms supplied by the analog converter 11 and the succession of the waveforms delivered by the sensors and generates an alarm signal at output terminal 18 if these two successions of waveforms are not identical. This occurs when there is modification of the state of the switch 1 or else when there is sabotage of a sensor or of one of the bus lines.

It is within the scope of a man skilled in the art to construct a complementary device for counting the number of clock pulses generated between the synchronizing time and the alarm time so as to identify which sensor has transmitted a response different from the expected response; and for checking the alarm over several interrogation cycles before delivering an alarm signal to the output terminal 18. Moreover, it is within the scope of a man skilled in the art to increase the number of sensors which may be used by increasing the number of clock pulses transmitted during each interrogation cycle, or to modify the number of amplitude levels of the plateaux of the synthesized waveforms. It is also possible to carry out differently individual interrogation addressing of each sensor, for example by replacing bus line 4 by a multi-conductor bus transmitting a binary word in parallel form.

The above-described interrogation mode has the advantage of great simplicity since a single bus line is sufficient to transmit addressing information, synchronization information and a clock signal. It is also possible to make the addressing more complex, to make neutralization of the system even more difficult, for example by generating addresses in a pseudo-random order.

It is also possible to use the process of the invention in a remote monitoring system where the sensors take the initiative of transmitting information without being previously interrogated by the central station.

Instead of using an analog comparator 12, it is also possible to digitize the wave form received by the central station 6 and to compare the values obtained with data stored in memory 10.

The waveforms transmitted in response by the sensors may be very complex, and are thus difficult to simulate, neutralization of the system being then practically impossible to achieve. The sensors comprise simple logic means which may be readily integrated in a hybrid circuit taking up little room, which may be situated in the immediate proximity of switches 1 or other means generating an alarm to be transmitted.

I claim:

1. A remote monitoring system comprising a central station and a plurality of sensors wherein each sensor comprises:

an alarm input terminal;

a synchronizing signal and clock signal separator having one input connected to the central station and having a first and a second output supplying respectively said synchronizing and said clock signal;

a counter having a reset input and a clock input connected respectively to the first and to the second output of the separator and having outputs;

a read only memory having address inputs connected respectively to the outputs of the counter, and having outputs, for supplying data for synthesizing a waveform;

a digital-analog converter having inputs connected respectively to the outputs of the read only memory and having an ouput, for supplying a variable amplitude signal;

an analog gate having an input connected to the output of the converter, a first control input connected to an output of the memory, a second control input connected to the alarm input terminal and having an output connected to the central station for transmitting the variable amplitude signal to the central station when the sensor is interrogated and when there is no alarm to be transmitted.

2. A remote monitoring system including a central station and a plurality of sensors, wherein said central station comprises:

an interrogation signal generator having an output connected by a first line to all of said sensors;

counting means having an input connected to the output of said generator and having outputs;

a read only memory having address inputs connected respectively to the outputs of the counting means and having outputs, for supplying data characteristics of a succession of waveforms identical to waveforms transmitted successively by all of said plurality of sensors of the system, in the absence of an alarm;

comparator means having inputs connected respectively to the outputs of the read only memory and an input connected to all of said sensors by a second line, and an output, for supplying an alarm signal when a sucession of waveforms received by the central station on said second line differs from said succession of waveforms identical to waveforms transmitted successively by all of said plurality of sensors of the system in the absence of an alarm.

3. A process for protecting a remote monitoring system against sabotage, wherein said system includes a central station connected to a plurality N of sensors, comprising the steps of:

sequentially testing each of said N sensors by feeding from said central station to said N sensors, an interrogation signal formed by a sychronizing pulse followed by a train of periodic pulses whose number P is at least equal to N and counting the pulses in each sensor which follow any of said synchronization pulses and triggering the transmission of a variable amplitude signal when the count has reached a predetermined value associated with each sensor and chosen from the whole numbers between 1 and P;

transmitting, from a tested sensor to the central station of the system, a signal of variable amplitude formed by a waveform synthesized from data stored in said tested sensor;

authenticating said signal of variable amplitude when said signal arrives at said central station by sampling said signal and comparing the value of each sample with a reference value.

* * * * *